US009546077B2

(12) United States Patent
Müller et al.

(10) Patent No.: US 9,546,077 B2
(45) Date of Patent: Jan. 17, 2017

(54) ELEVATOR DOOR WITH A DOOR CONTACT SWITCH

(71) Applicant: Inventio AG, Hergiswil (CH)

(72) Inventors: Rudolf J. Müller, Lucerne (CH); Eric Birrer, Buchrain (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 14/894,564

(22) PCT Filed: May 27, 2014

(86) PCT No.: PCT/EP2014/060888
§ 371 (c)(1),
(2) Date: Nov. 30, 2015

(87) PCT Pub. No.: WO2014/191379
PCT Pub. Date: Dec. 4, 2014

(65) Prior Publication Data

US 2016/0101967 A1 Apr. 14, 2016

(30) Foreign Application Priority Data

May 28, 2013 (EP) ..... 13169531

(51) Int. Cl.
*B66B 13/22* (2006.01)
*B66B 13/06* (2006.01)

(52) U.S. Cl.
CPC ..... *B66B 13/22* (2013.01); *B66B 13/06* (2013.01)

(58) Field of Classification Search
CPC ..... B66B 13/22
See application file for complete search history.

(56) References Cited

U.S. PATENT DOCUMENTS

| | | | | |
|---|---|---|---|---|
| 1,344,430 | A * | 6/1920 | Wigmore | B66B 13/18 187/316 |
| 6,732,839 | B2 * | 5/2004 | Schuster | B66B 13/22 187/247 |
| 7,097,001 | B2 * | 8/2006 | Martin | B66B 13/24 187/290 |
| 7,350,625 | B2 * | 4/2008 | Deplazes | B66B 13/22 187/314 |
| 7,500,650 | B2 * | 3/2009 | Deplazes | B66B 13/22 187/248 |
| 7,650,970 | B2 * | 1/2010 | Lelic | B66B 13/22 187/316 |

(Continued)

FOREIGN PATENT DOCUMENTS

| | | | |
|---|---|---|---|
| EP | 1473511 | A2 | 11/2004 |
| WO | 2005058738 | A2 | 6/2005 |
| WO | 2006036146 | A1 | 4/2006 |

*Primary Examiner* — Robert W Horn
(74) *Attorney, Agent, or Firm* — Fraser Clemens Martin & Miller LLC; William J. Clemens

(57) ABSTRACT

A switching device for an elevator door provides a door contact signal. The switching device includes a magnet, a plurality of proximity sensors, and a detection area, which area is adjoined by the proximity sensors and in which the magnet can be moved. A sensor signal can be generated by each of the proximity sensors in at least one position of the magnet in the detection area, wherein the sensor signals are dependent on the distance from the magnet to the proximity sensors. A method for providing the door contact signal utilizes the switching device.

16 Claims, 5 Drawing Sheets

(56) References Cited

U.S. PATENT DOCUMENTS

| | | | | |
|---|---|---|---|---|
| 8,807,285 | B2 * | 8/2014 | Kugiya | B66B 5/0031 187/301 |
| 2016/0101967 | A1 * | 4/2016 | Muller | B66B 13/06 187/335 |

* cited by examiner

ELEVATOR DOOR WITH A DOOR CONTACT SWITCH

FIELD

The invention relates to a switching device for an elevator door for providing a door contact signal. The invention additionally relates to a method of providing such a door contact signal by means of such a switching device.

BACKGROUND

Elevator installations comprise an elevator car and elevator doors, particularly a car door and shaft doors. For example, a shaft door is provided with at least one door contact switch by means of which it is monitored whether the shaft door is unlocked. Such door contact switches arranged at each individual shaft door are incorporated in a safety circuit. If one of these shaft doors is unlocked, the safety circuit is interrupted. In that way the elevator car can be moved only when all shaft doors of the elevator installation are locked. Moreover, further settings of such an elevator door can be monitored by means of door contact switches, particularly an open setting or closed setting.

WO 2006036146 shows a switching device for monitoring a door leaf belonging to an elevator door. The elevator door comprises, apart from the door leaf, a door surround, wherein the door leaf is lockable to the door surround. The switching device comprises a plurality of magnets and an equal number of proximity sensors. The magnets are arranged at the door leaf and the proximity sensors fastened to the door surround. Each of these proximity sensors is associated with exactly one individual magnet. In that case, the magnets have a defined geometric arrangement relative to one another. This defined geometric arrangement is equally imaged by the proximity sensors in such a way that the magnets simultaneously activate the proximity sensors on transition of the door leaf to its locked setting. This means that each proximity sensor has the same spacing from the magnet associated therewith. By means of a switching device defined in such a way it is possible to avoid simulation by an unauthorized person, by way of a permanent magnet held at the proximity sensors, a locked setting of the relevant elevator door even though this elevator door is, for example, still open.

It is problematic with such a switching device that such a spacing, which triggers the unlocked setting, of the magnets from the proximity sensors associated therewith can equally be influenced by faulty settings of, for example, a damaged door leaf. This means that a deviation of the magnets from their intended movement path near the locked setting of the door leaf signifies a displacement of the locked setting itself, which in turn can lead to failure of the elevator door and consequently to shutdown of the elevator installation.

SUMMARY

It is therefore an object of the invention to create a switching device for an elevator door with reduced probability of failure.

The object is fulfilled by a switching device for an elevator door, for providing a door contact signal, the switching device comprising a detection space, a plurality of proximity sensors, wherein the proximity sensors are arranged to adjoin the detection space, and a magnet movable in the detection space, wherein in at least one setting of the magnet in the detection space a sensor signal generated by this magnet can be produced by each of the proximity sensors in order to provide compensation, on the basis of evaluation of the sensor signals, for faulty settings of the magnet in the detection space, wherein the sensor signals are dependent on the spacing of the magnet from the proximity sensors.

The object is equally fulfilled by an elevator door with such a switching device.

The object is also fulfilled by a method for providing a door contact signal, wherein the method is performed by means of a switching device comprising a magnet, a plurality of proximity sensors and a detection space, and the proximity sensors are arranged at the detection space, with the following method steps:

- producing a first sensor signal, which is dependent on the spacing of the magnet from a first one of the proximity sensors, in a setting of the magnet in the detection space and
- producing a second sensor signal, which is dependent on a spacing of the magnet from a second one of the proximity sensors, in the same setting of the magnet in the detection space.

Current circuits, which are switchable by means of magnets, of elevator doors can cause faulty functions when solely one defined switching spacing of the magnet from the proximity sensor represents the criterion for switching of the corresponding door contact. A relevant spacing from elevator door components, in which the switching process is to take place, can be reliably established in such a way only if the magnet moves with respect to the proximity sensor along that movement path to which the switching device has been adjusted.

However, is not unusual that different components of the elevator door in the course of its operation are changed in such a way by external influences that the magnet no longer moves along its intended movement axis with respect to the proximity sensor. This can be caused by, for example, deformation of the door leaf or wear of individual guide elements guiding the door leaf. In correspondence with a thus-changed movement of the magnet in the environment of the proximity sensor the relevant spacing of the elevator door components from the instant of the switching process can be changed.

It was accordingly sought to so change the design of the switching device that a change of the elevator door of that kind has, to the largest extent, no influence on the relevant spacing. It is possible, by means of a plurality of proximity sensors each producing a sensor signal in dependence on the specific spacings thereof from the individual magnet, to trigger the switching process at this predetermined relevant spacing independently of changes to the elevator door by external influences. Accordingly, compensation for faulty settings of the magnet in the detection space can be provided on the basis of evaluation of the sensor signals.

In a development of the switching device the proximity sensors are formed by Hall sensors. Hall sensors are proximity sensors of simple construction and accordingly function with corresponding reliability.

In a development of the switching device the proximity sensors are arranged substantially on one side of an axis of movement of the magnet. Alternatively thereto the proximity sensors can be arranged substantially on both sides of this axis of movement of the magnet. By means of these alternatives, possibilities are given for evaluating the sensor signals in simple mode and manner.

A development of the switching device comprises two proximity sensors or three proximity sensors, which are preferably not arranged along a straight line. Depending on how the external influences act on the elevator door, a specific minimum number of proximity sensors is necessary in order to be able to determine the position of the magnet within the detection space and thus adhere in the long term to the described relevant spacing of the elevator door components during the switching process of the switching device. If it is anticipated that the axis of movement of the magnet displaces, due to the external influences, in the detection space in the switching device only along a plane, merely two proximity sensors are necessary for that purpose. However, if the elevator door components due to external influences are changed in such a way that the axis of movement of the magnet in the detection space can vary in any manner, three proximity sensors are necessary in order to maintain in the long term the relevant spacing of the elevator door components during the switching process of the switching device.

A development of the switching device comprises an evaluating unit which is constructed in such a way that by means of evaluation of the sensor signals a door contact is switched in the case of a predetermined depth of penetration of the magnet into the detection space. In that way a possibility is provided for processing the sensor signals, which relate to a position of a magnet in the detection space, of the proximity sensors and thus produce the door contact signal.

The evaluating unit can be constructed in such a way that reference signal values, which are signal values of the sensor signals produced in a reference setting of the magnet, can be stored in the evaluating unit and the reference signal values can be compared with the signal values of the sensor signals produced in an instantaneous setting of the magnet. In that way the effect of external influences on the elevator door can be determined. At the same time, a change, which is excessively large for this reason, of the instantaneous setting of the magnet from the reference setting of the magnet in the detection space can be detected or also precluded. Thus, failures of the elevator door can be precluded by preventative maintenance.

In a development of the switching device comprising the evaluating unit a minimum value can be stored in the evaluating unit and the evaluating unit can be constructed in such a way that the door contact is switched only when the signal values exceed the minimum value. Faulty functions of the switching device can be precluded by means of such an additional safety aspect if, for example, all other criteria for the switching process of the switching device are fulfilled.

A development of the switching device comprises a self-testing unit producing a magnetic pulse, wherein the self-testing unit acts in such a way on at least one of the proximity sensors that a signal value is produced by means of such a pulse. Functional disturbances of the switching device which occur can be recognized by means of such a self-testing unit acting on the sensor signal of the proximity sensor. In the case of full functionality of the switching device, the magnet pulse of the self-testing unit causes a signal value of the proximity sensor. The sensor signal is correspondingly influenced by this signal value. If an evaluation of the sensor signal has the result that the sensor signal is not influenced or is influenced in an unexpected way by the self-testing unit, a functional disturbance, which can be eliminated by a service engineer, of the switching device can, for example, be the cause.

A development of the elevator door comprises a locking device comprising two components to be locked relative to one another, wherein the components to be locked relative to one another are preferably a catch and a stop, or at least two components which are movable relative to one another, wherein the at least two components movable relative to one another are at least one door leaf and a door surround, wherein the proximity sensors are attached to a first one of the components and the magnet to a second one of the components. An arrangement of the proximity sensors and the magnet of that kind enables monitoring of a closed, open or any operational setting of the door leaf or a locked setting of the elevator door.

DESCRIPTION OF THE DRAWINGS

The invention is explained in more detail in the following by way of figures, in which.

DETAILED DESCRIPTION

Figure 1:
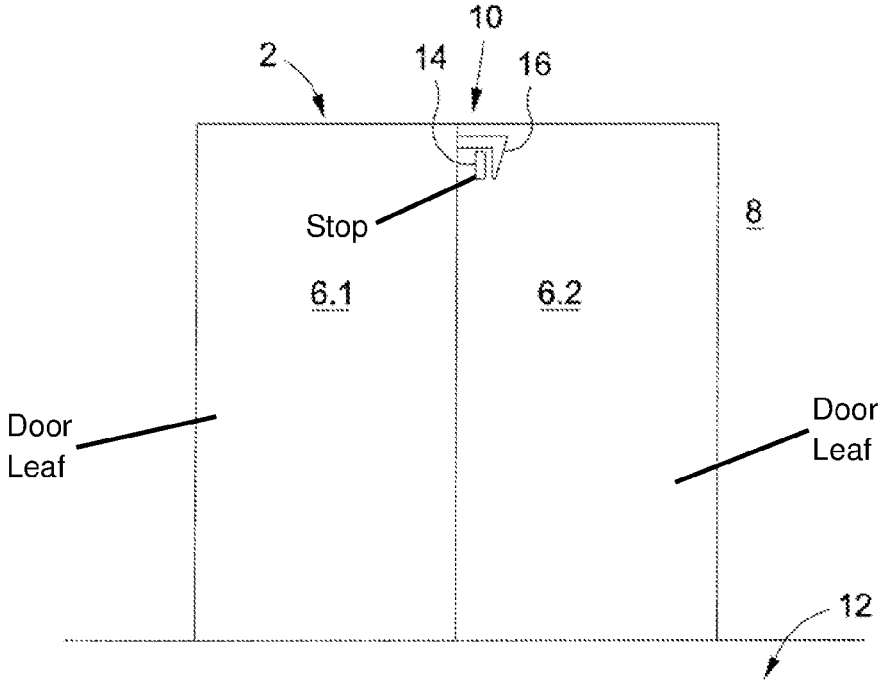
FIG. 1 shows an elevator door with a locking device.

FIG. 1 shows an elevator door 2 arranged in an elevator installation. The elevator door 2 can be constructed as a car door or as a shaft door arranged at a floor 12. The elevator door 2 comprises a door surround 8 and a first door leaf 6.1. In addition, the elevator door can comprise a second door leaf 6.2 and/or a locking device 10 for locking the door leaf 6.1.

The locking device 10 comprises a catch 16 and a mechanical stop 14. The catch 16 can, for example, be coupled with the first door leaf 6.1 and the stop 14 can be fastened to the second door leaf 6.2 or to the door surround 8. When the catch 16 is in engagement with the mechanical stop 14 an opening movement of the first door leaf 6.1 and optionally the second door leaf 6.2 is prevented. A switching device 4 (see FIGS. 2A, 2B, 3, 4A, 5A and 6) for monitoring the locked setting can be arranged at the locking device 10.

Figure 2A:
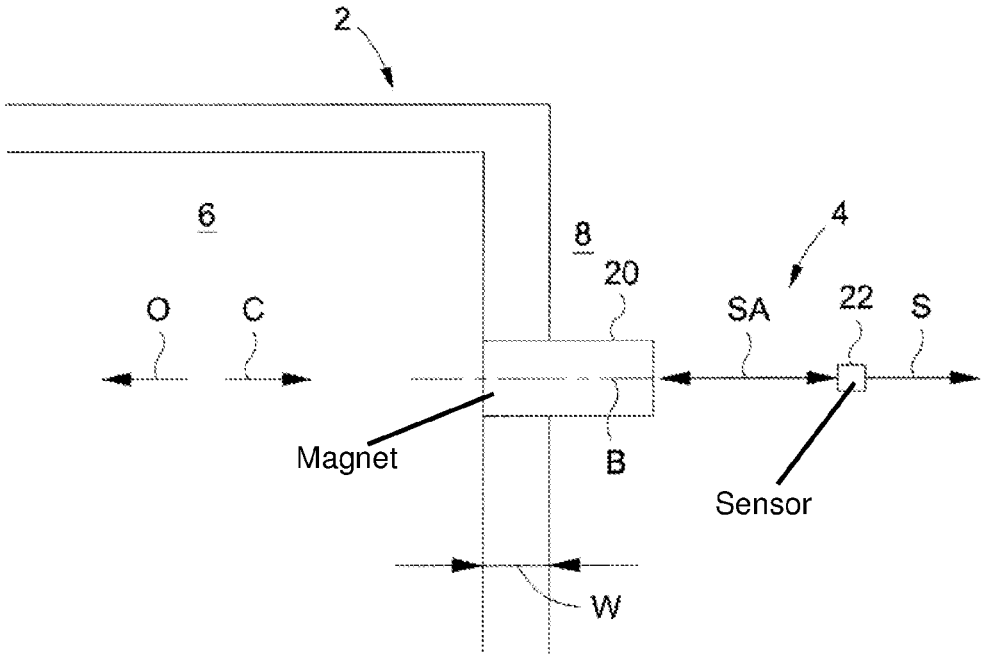
Fig. 2A (Prior Art)
FIGS. 2A, 2B show a switching device of an elevator door according to the prior art.
Figure 2B:
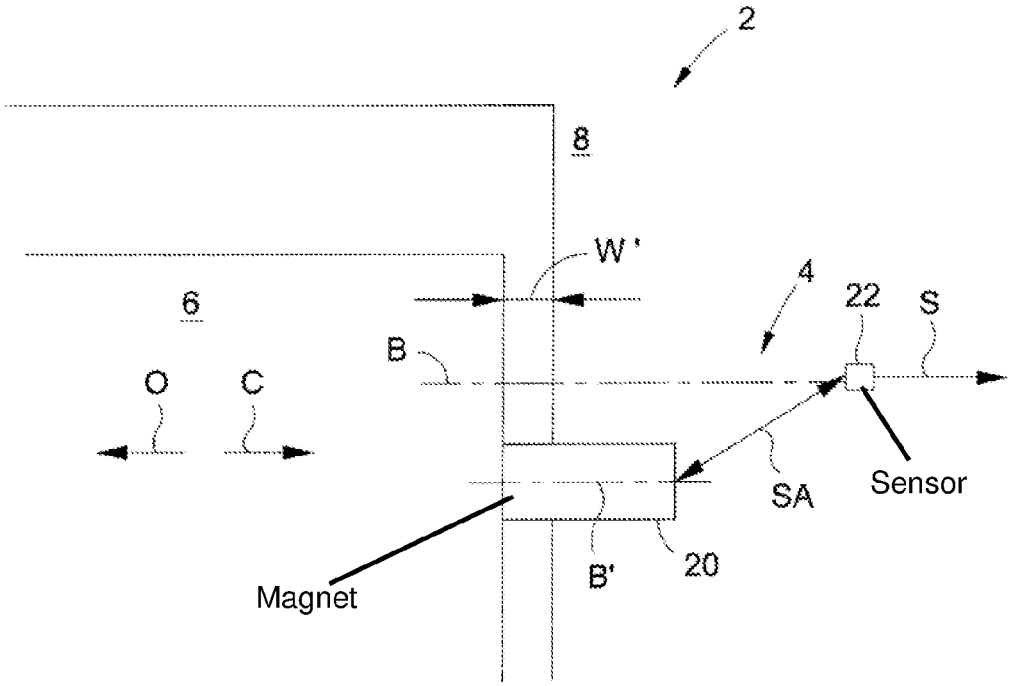
Fig. 2B (Prior Art)

A switching device 4 of an elevator door 2 according to the prior art is illustrated in simplified form in FIGS. 2A, 2B. The elevator door 2 comprises a door leaf 6, which is shown in its closed setting, and a door surround 8. The switching device 4 for monitoring the closed setting of the door leaf 6 comprises a magnet 20 and a proximity sensor 22. The magnet 20 is fastened to the door leaf 6. The proximity sensor 22 is fastened to the door surround 8 and has a detection spacing SA. The detection spacing SA characterizes the maximum distance between the magnet 20 and the proximity sensor 22, sufficient for producing a door contact signal S.

FIG. 2A shows the elevator door 2 in the state in accordance with an adjustment, which has been carried out, of the switching device 4 by a service engineer. The service engineer had at the moment of the adjustment the possibility of determining the fastening position of the proximity sensor 22 and/or the magnet 20 in such a way that a door contact signal S detecting the closed signal is issued when the door leaf 6 has a maximum gap spacing W from the door surround 8. Such an adjustment is based on the detection spacing SA. Correspondingly, the door contact signal S is interrupted when the door leaf 6 is moved in opening direction O in such a way that the spacing between the magnet 20 and the proximity sensor 22 is greater than the detection spacing SA. In correspondence with the adjustment, the magnet 20 moves, in the case of the movement of the door leaf 6 in opening direction O or closing direction C, along its intended axis B of movement.

FIG. 2B shows the door leaf 6 in its closed setting, after external influences have produced a change of components of the elevator door 2. For example, such changes can be caused by deformations of the door leaf 6 produced by elevator passengers or by wear of guide elements of the door leaf 6. Accordingly, in the case of movement of the door leaf 6 in opening direction O or closing direction C the magnet 20 no longer moves along its intended axis B of movement, but moves along a changed axis B' of movement. Due to the detection spacing SA, which is substantially unchanged since the moment of adjustment of the switching device 4 by the service engineer, there is therefore the result according to FIG. 2B that the switching process of the switching device takes place at a maximum gap spacing W' changed with respect to the maximum gap spacing W. Accordingly, the door contact signal S is issued only when the changed maximum gap spacing W' is exceeded. In the least favorable case the door leaf 6 can adjoin the door surround 8 without a door contact signal S which detects the closed setting of the door 6, because the resulting spacing of the magnet 20 from the proximity sensor 22 is greater than the detection spacing SA. If this door contact signal S is essential for continued operation of the elevator installation this leads to a temporary failure of the elevator installation until the switching device 4 is readjusted by a service engineer.

Figure 3:
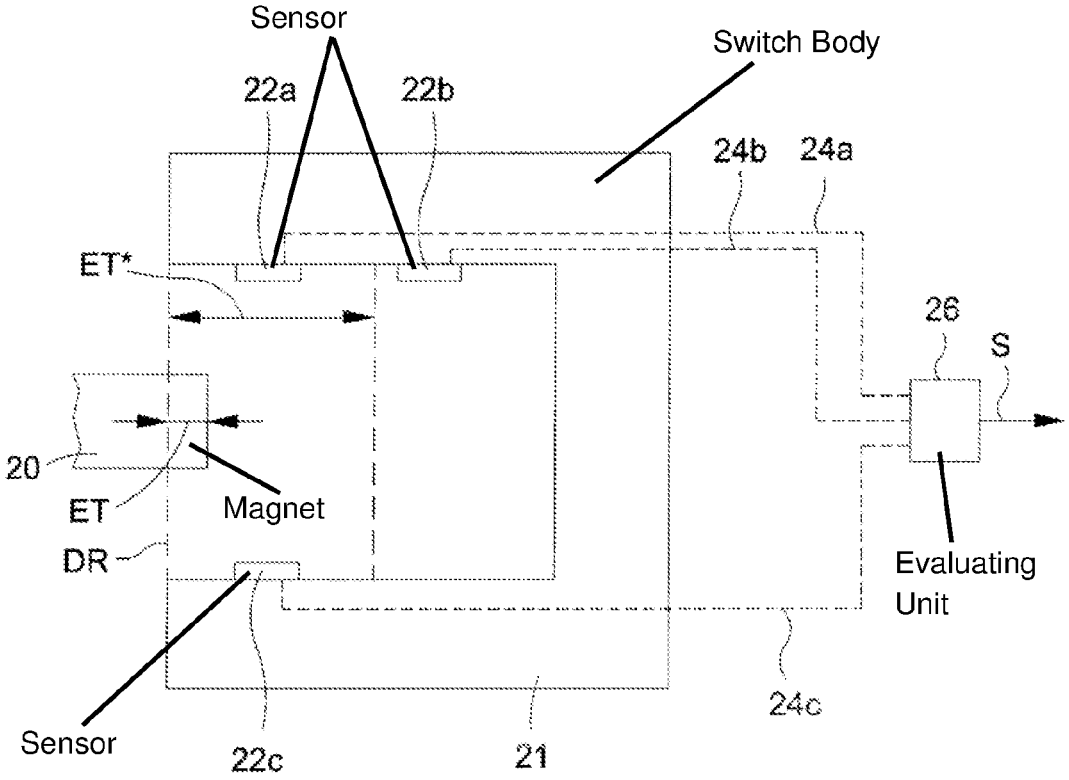
FIG. 3 shows a switching device for an elevator door.

An exemplifying switching device 4 according to the invention is shown in FIG. 3. A switching device 4 comprises a magnet 20, a detection space DR and at least two proximity sensors 22*a*, 22*b*. 22*c*. In addition, the switching device 4 can comprise an evaluating unit 26. The proximity sensors 22*a*, 22*b*, 22*c* are arranged adjacent to the detection space DR. For example, the switching device 4 comprises a switch body 21 to which the proximity sensors 22*a*, 22*b*, 22*c* are fastened.

In the case of monitoring of the locking setting explained in accordance with FIG. 1 the magnet 20 can be arranged, preferably fastened, at the catch and the proximity sensors 22*a*, 22*b*, 22*c* can be arranged, preferably fastened, at the stop, or vice versa. Alternatively thereto, the switching device 4 can be provided for monitoring an open or a closed setting or any operational setting of the door leaf. For this purpose, the proximity sensors 22*a*, 22*b*, 22*c* can be arranged, preferably fastened, at the first door leaf and the magnet 20 can be arranged, preferably fastened, at the optionally present second door leaf or at the door surround, or vice versa. If the door leaf or the catch is in the setting to be monitored or in the immediate vicinity thereof, the magnet 20 has a depth ET of penetration into the detection space DR. Accordingly, the magnet 20 enters at least partly into the detection space DR. The switching device 4 is constructed or adjustable in such a way that a door contact is switched in the case of a predetermined penetration depth ET* into the detection space DR.

In correspondence with the spacing of the magnet 20, which has entered at least partly into the detection space DR, from each individual one of the proximity sensors 22*a*, 22*b*, 22*c*, at least one of the proximity sensors 22*a*, 22*b*, 22*c* produces a sensor signal 24*a*, 24*b*, 24*c* which can be associated with the respective proximity sensor 22*a*, 22*b*, 22*c*. The at least one sensor signal 24*a*, 24*b*, 24*c* can be communicated to the evaluating unit 26. If at least two sensor signals 24*a*, 24*b*, 24*c* are present a penetration depth ET of the magnet 20 can be determined by evaluation of these sensor signals 24*a*, 24*b*, 24*c* and optionally the current direction of movement of the door leaf. For example, this evaluation can be carried out with the help of mathematical algorithms which describe a dependence of the sensor signal 24*a*, 24*b*, 24*c* on the spacing of the magnet 20 from the associated proximity sensors 22*a*, 22*b*, 22*c*. If the penetration depth ET of the magnet 20 corresponds with the predetermined penetration depth ET*, a door contact can be switched by means of issue of a door contact signal S. The door contact signal S accordingly signals that the door leaf has reached or passed the closed, open or locked setting or the previously arbitrarily established operating position.

Figure 4A:
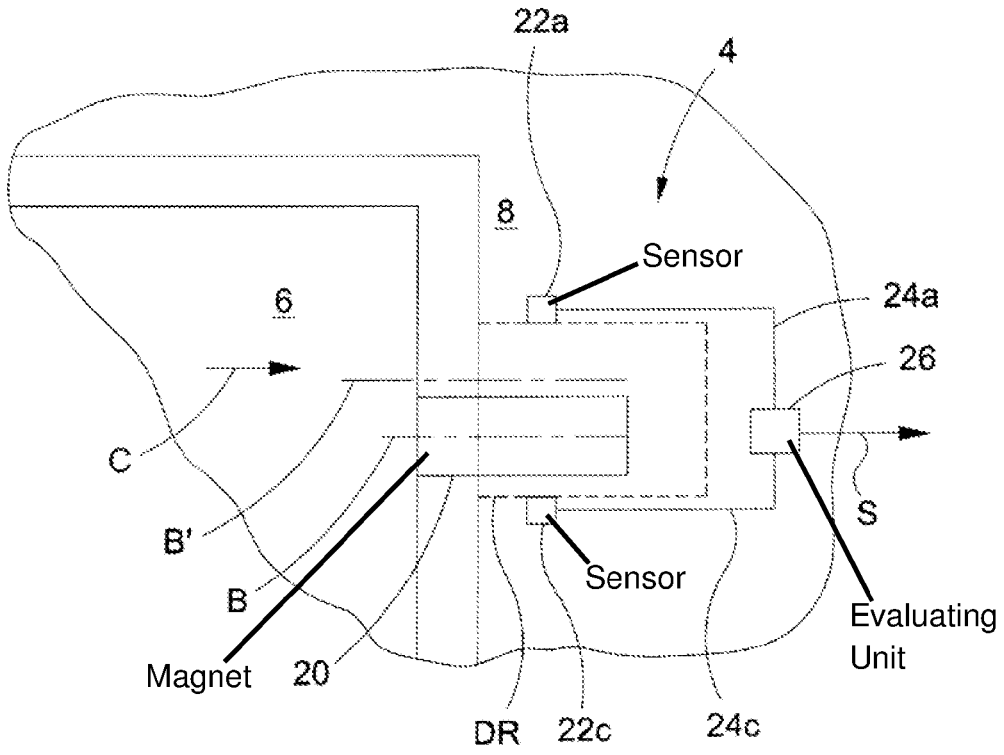
FIG. 4A shows a switching device of an elevator door according to a first variant of embodiment.
Figure 5A:
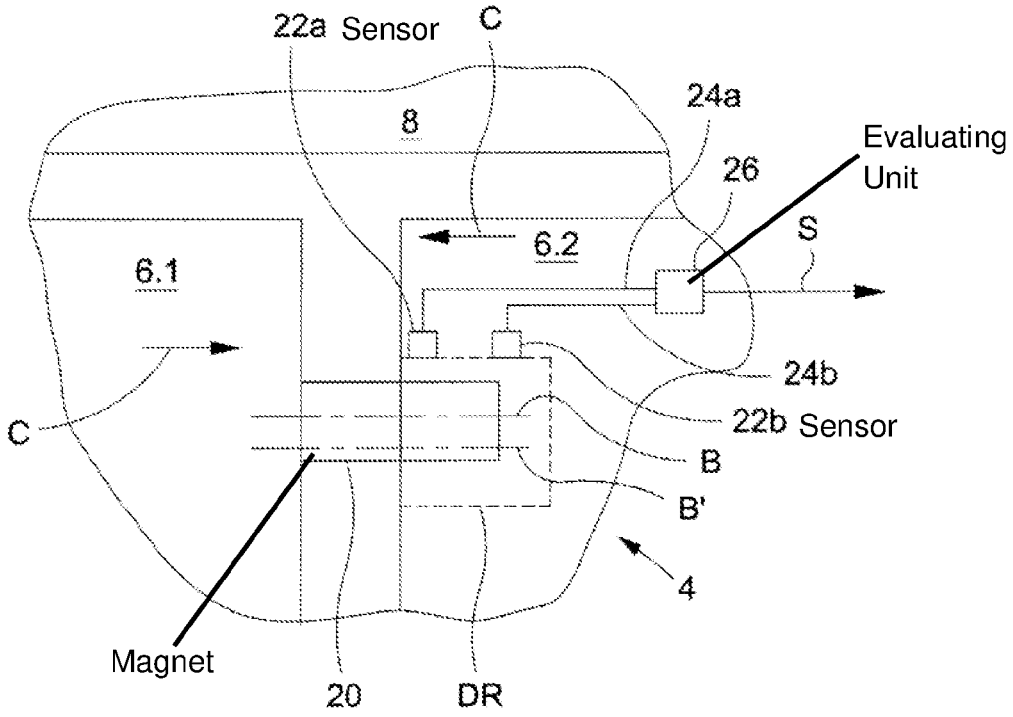
FIG. 5A shows a switching device of an elevator door according to a second variant of embodiment.
Figure 6:
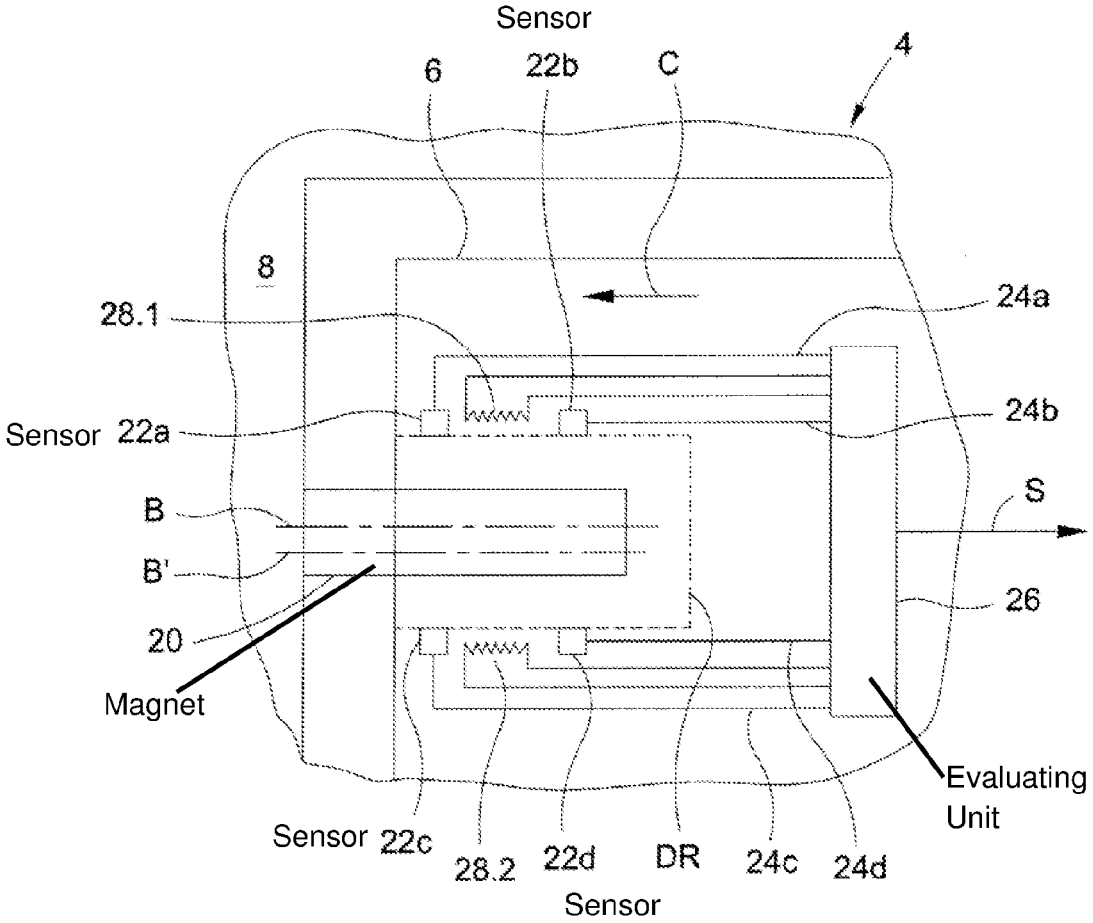
FIG. 6 shows a switching device of an elevator door according to a third variant of embodiment.

FIGS. 4A, 5A, 6 show components of an elevator door with a switching device 4 according to different variants of embodiment. The elevator door comprises the components of the elevator door illustrated in FIG. 1. The switching device 4 comprises a magnet 20, a detection space DR and at least two proximity sensors 22*a*, 22*b*, 22*c*, 22*d* and can include an evaluating unit 26. The proximity sensors 22*a*, 22*b*, 22*c*, 22*d* are arranged adjacent to the detection space DR. The magnet 20 is fastened to the door leaf 6 and the proximity sensors 22*a*, 22*c* are fastened to the door surround 8 (FIG. 4A) or vice versa (FIG. 6). Alternatively thereto the magnet 20 can be fastened to a first door leaf 6.1 and the proximity sensors 22*a*, 22*b* to a second door leaf 6.2 (FIG. 5A).

In the case of a closing movement C of the at least one at least partly opened door leaf 6, 6.1, 6.2 the magnet 20 enters the detection space DR. The magnet 20 is in that case moved along a predetermined axis B of movement with respect to the detection space DR, in which case external influences can lead to a changed axis B' of movement. The proximity sensors 22*a*, 22*b*, 22*c*, 22*d* each produce a sensor signal 24*a*, 24*b*, 24*c*, 24*d*, which can be associated with the respective proximity sensor 22*a*, 22*b*, 22*c*, 22*d* when the magnet 20 is in the detectable vicinity of the respective proximity sensor 22*a*, 22*b*, 22*c*, 22*d*. The sensor signals 24*a*, 24*b*, 24*c*, 24*d* can be communicated to the evaluating unit 26 and evaluated within the evaluating unit 26. If the evaluation, in a given case a comparison, of the sensor signals 24*a*, 24*b*, 24*c*, 24*d* by the evaluating unit 26 has the result that the door leaf 6.1 in accordance with the purpose of the switching device 4 is locked or closed or opened or adopts a defined operating position the door contact signal S is issued. Such a door contact signal S can be used for, for example, switching a safety circuit of the elevator installation. If the evaluation of the sensor signals 24*a*, 24*b*, 24*c*, 24*d* by the evaluating unit 26 has the result that the door leaf 6.1 is no longer locked or closed or opened or adopts the defined operating position, the door contact signal S is stopped.

A number of at least two proximity sensors 22*a*, 22*b*, 22*c* is necessary if it can be assumed that the movement axis B' of the magnet 20 in the detection space DR, even after occurrence of the influences changing the elevator door components, is changed substantially only along a plane such as, for example, the plane of illustration shown in accordance with FIGS. 4A, 5A. Thereagainst, a number of at least three proximity sensors 22*a*, 22*b*, 22*c* (for example FIG. 6), preferably not arranged along a straight line, is necessary if the magnet 20 after occurrence of the influences changing the elevator door components can have in the detection space DR a movement axis B' changed in any way.

FIG. 4A shows the switching device 4 according to a first variant of embodiment in which the proximity sensors 22*a*, 22*c* are arranged substantially at both sides of the movement axis B, B', which is changed in certain circumstances by means of external influences, of the magnet 20.

FIG. 5A shows the switching device 4 according to a second variant of embodiment in which the proximity sensors 22*a*, 22*b* are arranged substantially on one side of the movement axis B, B', which is changed in certain circumstances by means of external influences, of the magnet 20.

Figure 4B:
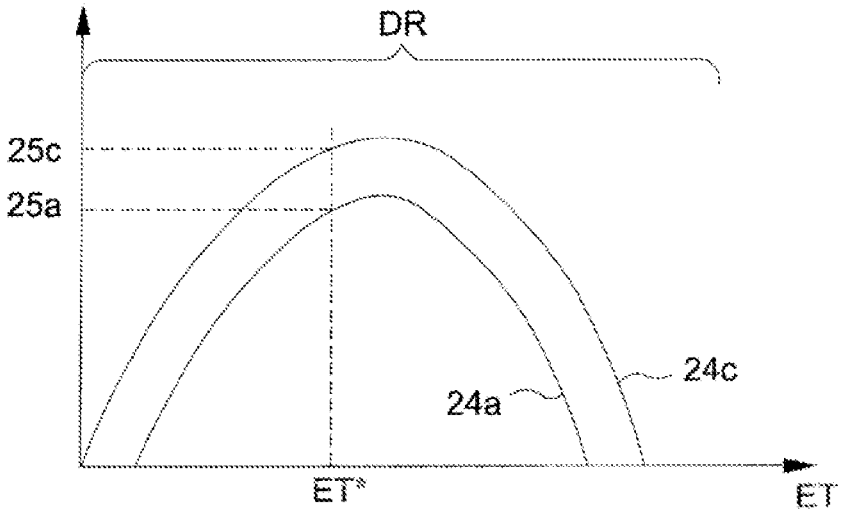
FIG. 4B shows a signal plot of the switching device shown in FIG. 3A.
Figure 5B:
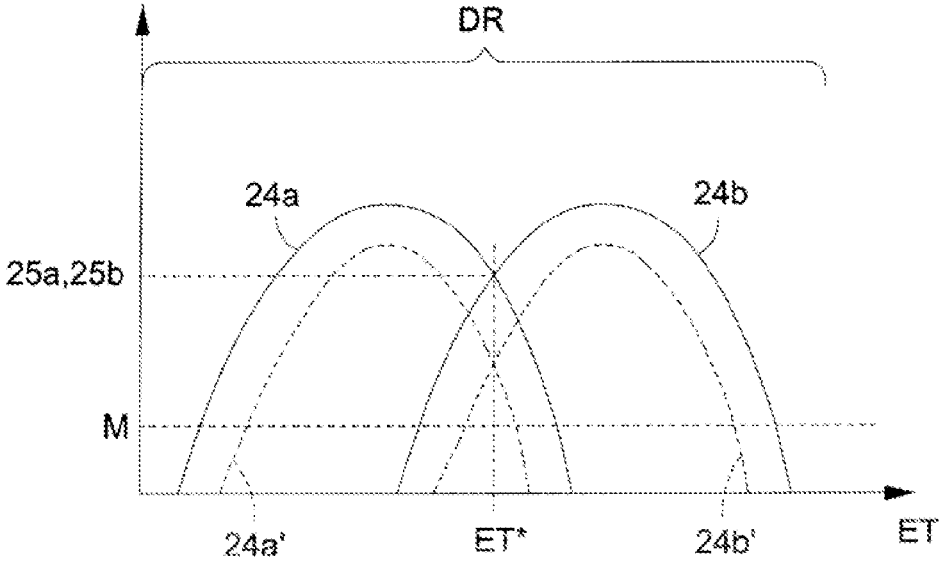
FIG. 5B shows a signal plot of the switching device shown in FIG. 5A.

FIGS. 4B and 5B show signal plots of the switching devices 4 shown in FIGS. 4A and 5A. Signal values, particularly the signal strengths, of the sensor signals 24*a*, 24*b*, 24*c* in dependence on the penetration depth ET of the magnet 20 into the detection space DR are depicted in these signal plots. In that case, a higher signal strength in the illustrated FIGS. 4A, 5A corresponds with a reduced spacing of the magnet 20 from the relevant proximity sensor 22*a*, 22*b*, 22*c*. It is known on the basis of the sensor characteristic of the individual proximity sensors 22*a*, 22*b*, 22*c* which spacing the magnet 20 has from the corresponding proximity sensor 22*a*, 22*b*, 22*c* for the detected signal value 24*a*, 24*b*, 24*c*. Accordingly, a position of the magnet 20 in the detection space DR can be detected from the sensor signals 24*a*, 24*b*, 24*c* of at least two proximity sensors 22*a*, 22*b*, 22*c*. In that way it is made possible by means of evaluation of the sensor signals 24*a*, 24*b*, 24*c* within the evaluating unit 26 to switch the door contact by means of the door contact signal S in the case of a predetermined penetration depth ET* of the magnet 20 into the detection space DR.

The evaluating unit 26 can be constructed in such a way that, on adjustment of the switching device 4, signal values 24*a*, 24*b*, 24*c* of the proximity sensors 22*a*, 22*b*, 22*c* at a predetermined penetration depth ET* of the magnet can be stored as reference signal values 25*a*, 25*b*, 25*c*. The reference signal values 25*a*, 25*b*, 25*c* therefore characterize a reference setting of the magnet 20 for the predetermined penetration depth ET*.

Through comparison of the signal values, which occur at the predetermined penetration depth ET* in the course of operation of the elevator door, of the sensor signals 24*a*, 24*b*, 24*c* with the reference signal values 25*a*, 25*b*, 25*c* it is possible to determine to what extent the instantaneous position of the magnet 20 departs from the position of the magnet 20 at the time of adjustment of the switching device 4 for the predetermined penetration depth ET*. Accordingly, it can be recognized to what extent external influences have contributed to deformation of the elevator door. Moreover, it can be estimated within which period of time readjustment of the elevator door has to be carried out without risk of failure of the elevator door due to faulty functioning of the elevator door. Through issue of an adjustment request signal in the case of a predeterminable departure of these signal values of the sensor signals 24*a*, 24*b*, 24*c* from the reference signal values 25*a*, 25*b*, 25*c* such a failure of the elevator installation can be prevented. In the case of determination of the difference leading to an adjustment request signal it is possible to take into consideration, for example, mass tolerances of components and the size of the detection space DR of the switching device 4.

In FIG. 5B exemplifying plots of those signal values of the sensor signals 24*a*', 24*b*' resulting from movement of the magnet 20 along its changed axis B' of movement are shown by dotted line. According to the depicted illustration the switching device 4, in the case of an arrangement of the proximity sensors 22*a*, 22*b* substantially on one side of the movement axis B, B'— which is changed in certain circumstances—of the magnet 20, can be so adjusted that the criterion for issue of the door contact signal S is signal values 24*a*, 24*b*; 24*a*', 24*b*', which are of the same level, of the proximity sensors 22*a*, 22*b*. A minimum value M stored in the evaluating unit 26 is required in the case of such an evaluation in order to prevent issue of the door contact signal S when the signal values 24*a*, 24*b*, 24*a*', 24*b*' are smaller than this minimum value M.

FIG. 6 shows a switching device 4 of an elevator door according to a third variant of embodiment. The switching device 4 can, when an evaluating unit 26 is present, comprise a self-testing unit 28.1, 28.2. The self-testing unit 28.1, 28.2—for example comprising at least one electromagnet acting on the proximity sensors 22*a*, 22*b*, 22*c*, 22*d*—produces magnetic pulses at predeterminable frequency. Magnetic pulses act on the proximity sensors 22*a*, 22*b*, 22*c*, 22*d*, whereupon the proximity sensors 22*a*, 22*b*, 22*c*, 22*d* produce signal values corresponding with the pulses. These signal values produced by means of the pulses are superimposed on the signal plots, which are generated on the basis of the detection of the magnet 20, of the sensor signals 24*a*, 24*b*, 24*c*, 24*d*. It can accordingly be recognized by means of evaluation of the sensor signals 24*a*, 24*b*, 24*c*, 24*d* within the evaluating unit 26 whether the proximity sensors 22*a*, 22*b*, 22*c*, 22*d* process or the switching device 4 processes these produced pulses in an anticipated manner. If this is not the case, that can mean a functional disturbance of the switching device 4. Accordingly, a fault signal can be produced, which generates, for example, a servicing request for servicing of the switching device 4.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A switching device for an elevator door for providing a door contact signal, the switching device comprising:

a detection space formed in the switching device;

a plurality of proximity sensors adjoining the detection space; and a magnet movable in the detection space, wherein in at least one setting of the magnet in the detection space the magnet generates a sensor signal from each of the proximity sensors to provide compensation, on a basis of evaluation of the sensor signals, for faulty settings of the magnet in the detection space, wherein the sensor signals are dependent on a spacing of the magnet from the proximity sensors.

2. The switching device according to claim 1 wherein the proximity sensors are formed by Hall sensors.

3. The switching device according to claim 1 wherein the proximity sensors are arranged on one side of an axis of movement of the magnet in the detection space.

4. The switching device according to claim 1 wherein the proximity sensors are arranged on both sides of an axis of movement of the magnet in the detection space.

5. The switching device according to claim 1 wherein the plurality of proximity sensors is two of the proximity sensors or three of the proximity sensors.

6. The switching device according to claim 1 including an evaluating unit for evaluating all of the sensor signals to determine a depth of penetration of the magnet into the detection space and for generating the door contact signal to switch a door contact when a predetermined depth of penetration of the magnet into the detection space is determined.

7. The switching device according to claim 6 wherein the evaluating unit stores reference signal values, which are signal values of the sensor signals produced in a reference setting of the magnet in the detection space, and compares the reference signal values with the signal values of the sensor signals generated in an instantaneous setting of the magnet.

8. The switching device according to claim 6 wherein the evaluating stores a minimum value and generates the door contact signal only when signal values of the sensor signals exceed the minimum value.

9. The switching device according to claim 1 including a self-testing unit that produces magnetic pulses to act on at least one of the proximity sensors to generate an associated one of the sensor signals with a signal value corresponding to the pulses.

10. An elevator door wherein the switching device according to claim 1 provides the door contact signal.

11. The elevator door according to claim 10 including a locking device having two components to be locked relative to one another, wherein the components are a catch and a stop, and wherein the proximity sensors are fastened to a first one of the components and the magnet is fastened to a second one of the components.

12. The elevator door according to claim 10, wherein the elevator door has at least two components movable relative to one another, wherein the at least two components are at least one door leaf and a door surround, and wherein the proximity sensors are fastened to a first one of the components and the magnet is fastened to a second one of the components.

13. A method of providing a door contact signal using a switching device including a magnet, a plurality of proximity sensors and a detection space formed in the switching device, wherein the proximity sensors are arranged at the detection space, comprising the steps of:

producing a first sensor signal dependent on a spacing of the magnet from a first one of the proximity sensors in a setting of the magnet in the detection space;

producing a second sensor signal dependent on a spacing of the magnet from a second one of the proximity sensors in the setting of the magnet in the detection space; and evaluating the first and second sensor signals to provide compensation for faulty settings of the magnet in the detection space.

14. The method according to claim 13 including further steps of:

performing the evaluating of the first and second sensor signals with an evaluating unit of the switching device; and switching a door contact in response to a predetermined depth of penetration of the magnet into the detection space.

15. The method according to claim 14 wherein a depth of penetration of the magnet into the detection space is determined on the basis of the evaluating.

16. The method according to claims 14 including further steps of:

determining a first reference signal value of the first sensor signal in a reference setting of the magnet in the detection space;

determining a second reference signal value of the second sensor signal in the reference setting of the magnet;

storing the first and second reference signal values in the evaluating unit;

comparing the reference signal values with signal values of the first and second sensor signals respectively generated in an instantaneous setting of the magnet in the detection space; and issuing an adjustment request signal in response to an excessive departure, which is determined on the basis of the comparing of the reference signal values with the signal values in the instantaneous setting of the magnet, of the reference setting from the instantaneous setting of the magnet.

* * * * *